United States Patent [19]

Henschel

[11] Patent Number: 4,815,426

[45] Date of Patent: Mar. 28, 1989

[54] ENGINE HEATER, SMALL, PORTABLE

[76] Inventor: Paul S. Henschel, 82 Laurelwood Rd., Groton, Conn. 06340

[21] Appl. No.: 19,506

[22] Filed: Feb. 26, 1987

[51] Int. Cl.[4] ..... F01M 5/02; F02N 17/04

[52] U.S. Cl. ..... 123/142.5 R; 431/350

[58] Field of Search ..... 123/142.5 R; 431/350

[56] References Cited

U.S. PATENT DOCUMENTS

| | | | |
|---|---|---|---|
| 1,414,539 | 5/1922 | Wilson | 123/142.5 R |
| 1,566,758 | 12/1925 | Martin | 431/350 |
| 1,786,130 | 12/1930 | Schoenfeld | 123/142.5 R |
| 1,862,114 | 6/1932 | Gilly | 123/142.5 R |
| 2,078,116 | 4/1937 | Arndt | 123/142.5 R |
| 2,092,497 | 9/1937 | Breese | 123/142.5 R |
| 3,276,509 | 10/1966 | Fredhold, Jr. et al. | 431/350 |
| 3,277,886 | 10/1966 | Ryals et al. | 123/142.5 R |
| 3,400,700 | 9/1968 | Lindsey et al. | 123/142.5 R |
| 3,630,649 | 12/1971 | Hancock | 431/350 |
| 3,809,527 | 5/1974 | Newman | 123/142.5 R |

*Primary Examiner*—Willis R. Wolfe

[57] ABSTRACT

An engine heater for automotive vehicles which adapts a common propane torch to accomplish the heating. The prime features of the invention are its simplicity, compactness, economy, ease of being carried in the vehicle, and its not needing any installation in or modification to the vehicle in order to be used. Heat is safely applied over a relatively large area of the bottom of a vehicle's engine oil pan and then the heated oil pan and oil will cause the critical interior portions of the engine to be warmed; thus, greatly enhancing the engine's ability to start and run in very cold weather. The device also includes means of preventing strong wind from either blowing out the flame or carrying most of the heated air/exhaust gas discharge away from the bottom of the engine.

5 Claims, 2 Drawing Sheets

ENGINE HEATER, SMALL, PORTABLE

BACKGROUND AND RELATED APPLICATIONS

Numerous patents for heating devices for enabling the starting of internal combustion engines in cold weather attest to the need for engine warming in very cold weather. While modern engines and oils are generally very good at starting when moderately cold, even the very best of engines are unlikely to start if they are −25° F. or colder. Combinations of oil viscosity, battery or starter condition, engine size, low speed torque characteristics, etc. may make even much more normal temperatures, such as '15° F., too cold to start some engines without some warming means being applied. The point is that engine warmers frequently are needed even in relatively temperate geographical areas, i.e., not just in the extreme cold weather areas. The concept is a viable one based on the quantity of engine warmers which have been proposed and/or produced.

Several related patents are discussed below:

a. ENGINE HEATERS

As stated above, numerous patents exist for engine heaters using various means of accomplishing the warming of an engine. U.S. Pat. Nos. 1,786,130 to W. Schoenfeld, 3,114,360 to C.D. Snelling, 3,809,527 to R. Newman, and 4,445,469 to L. Suhayda describe means of warming the underside and/or oil pan of automobile engines for the purpose of starting said engines in a cold environment.

It can be seen that the invention herein described is intended to accomplish the same general result but is much simpler and cheaper as well as being substantially different in configuration from the other patented engine heaters noted above. These four existing patents are not suitable for usage either away from home or away from power sources. None of the four patents cited describe a simple, low cost, compact emergency type of heater which is to be carried in the vehicle's trunk or equivalent stowage space in case it is needed.

The many patented engine heaters which utilize electric heating elements to heat engines by heating the block directly, or the engine coolant fluid, or the engine lubricating oil as in U.S. Pat. No. 3,171,015 Dip Stick Heater to G.H. Grinde are obviously quite different from the invention described herein.

U.S. Pat. Nos. 1,414,539 granted to Wilson, 3,213,263 to Steenbergen, and 4,370,956 to Moser are representative of many other engine heater patents which have been granted all of which differ substantially from this invention.

An examination of the other patented engine heaters will show that they fall into one or more of the following categories of differences from this invention.

The other patents are different in that:

(a) They either require an external electric energy source, or (b) They require some, usually permanent, installation work on the vehicle, or (c) They are expensive and/or complex systems, or (d) They are bulky and not intended to be carried in the vehicle, or (e) They are not inexpensive, compact devices intended to be carried in the vehicle for emergency usage in remote areas without either installation or external power sources required.

b. FLAME SHIELDS:

A portion of the invention includes means for shielding the heater flame from wind, minimizing heat loss and also preventing direct flame impingement on the bottom of the engine oil pan. Various flame protecting means are presently patented. U.S. Pat. No. 1,566,758 to Martin describes a protecting hood for gasoline blowtorches and the like. U.S. Pat. No. 3,276,509 to Fredhold and Wilkinson describes a flame protector for gas burners of the type used in gas refrigerators used for house trailers, campers and the like. U.S. Pat. No. 3,630,649 to Hancock and Westerman describes several means of shrouding and controlling gas burner flames.

The direct impingement barrier and flame protection means employed in this invention, while having some commonality with the cited prior art and other flame protectors, will however be found upon careful examination to be unique in their totality to suit the objective of the invention.

The flame protection means employed in the preferred embodiments of this invention is unlike the shrouded burners of Hancock and Westerman, U.S. Pat. No. 3,630,649 in the following ways:

1. There is no attempt made to alter the flame shape from that of the standard torch burner to which the invention is attached. The standard burner has its own flame holding features.

2. In this invention, the intake air approaching the inlet to the standard torch burner passes through an annular space created by an intake shielding hollow cylinder which is closed off at its lower end and which, at its upper end, has an inside diameter larger than the standard torch burner or nozzle outside diameter and which surrounds the lower portion of the standard torch burner or nozzle. This shielding cylinder causes the intake air to make two changes in direction and prevents wind pressure from acting directly on the burner air intake and makes the air intake pressure nearly equal to the exhaust discharge pressure when working in combination with the upper flame shield of the invention.

3. At the top of the flame protecting enclosure or shield there is a hinged flame impingement barrier which has an easy locking and unlocking feature.

4. None of the Hancock and Westerman burners have the mixing of air and gas in the axially drafted air intake manner common to commercial propane torch burners which this invention utilizes.

The flame protection means utilized in the preferred embodiments of this invention is also unlike the flame protection means which are described in U.S. Pat. Nos. 1,566,758 to Martin and 3,276,509 to Fredhold and Wilkinson in the following ways:

1. An intake shielding hollow cylinder is configured and fitted to the standard torch nozzle and its gas supply pipe in such a way that, in combination with the upper shielding cone or the like, wind pressure is essentially balanced between inlet and outlet sides of the torch burner or nozzle. Without this approximate balancing of wind pressure, strong winds will either seriously disrupt the normal inlet air draft induction into the burner mixing chamber of common propane torches or also, in some cases, back up the exhaust gas discharge and cause extinguishment of the flame by either means.

2. The flame protection means also includes a quick acting lock/unlock feature which allows the top portion, which is primarily a flame impingement barrier but also part of the wind protection means for the flame, to be swung up and out of the way for lighting the torch then quickly locked down in its operating position.

3. The flame protection means in both of the preferred embodiments is configured so that the upper flame protector cone or the like slips over the upper end of a standard torch nozzle or burner and is simply clamped to it. The lower, intake, shielding hollow cylinder is also easily installed and its upper end forms an annular intake air flow passage between it and the lower part of the torch nozzle or burner.

The lower end of the lower, intake, shielding cylinder is sealed to the gas supply pipe preferably with a split high temperature resistant elastomer grommet or by some other means.

Note that in any event the preferred embodiments of the flame shielding means are only a portion of the invention and not the total invention which is primarily a novel and practical engine heater which quickly adapts standard propane torches for this purpose.

SUMMARY OF THE INVENTION

The invention described herein is a simple, small, light and inexpensive unit which can be added to a common propane torch to make an effective engine heater when its hot gas discharge, combustion product and air, is placed under the oil pan of a conventional automotive vehicle's engine. It is felt to be a very practical unit for accomplishing the intended purpose unlike many other devices which have been patented but most of which have not been widely used.

This invention is intended for occasional use and for being carried in an automotive vehicle in case it is needed at any time during winter operation. It is conceded that for normal, routine, engine heating at home in cold climates, other means such as dip stick heaters or other more elaborate units would be more convenient and appropriate.

The invention provides a means of heating a cold engine without requiring any electrical input, A.C. or D.C.. The vehicle may be in a remote area where no external power source is available. Further, the invention does not drain energy from the vehicle's battery which the vehicle can ill afford to have expended since it must save its stored energy for cranking the engine.

It will be obvious that the invention also does not require any modification to the vehicle or engine but rather is simply placed so that the exhausted hot gases and air are directly under the engine oil pan.

The invention also includes effective means for preventing the torch flame from being blown out in a strong wind or from its heat being largely diverted away from the bottom of the engine.

DETAILED DESCRIPTION

Figure 1:
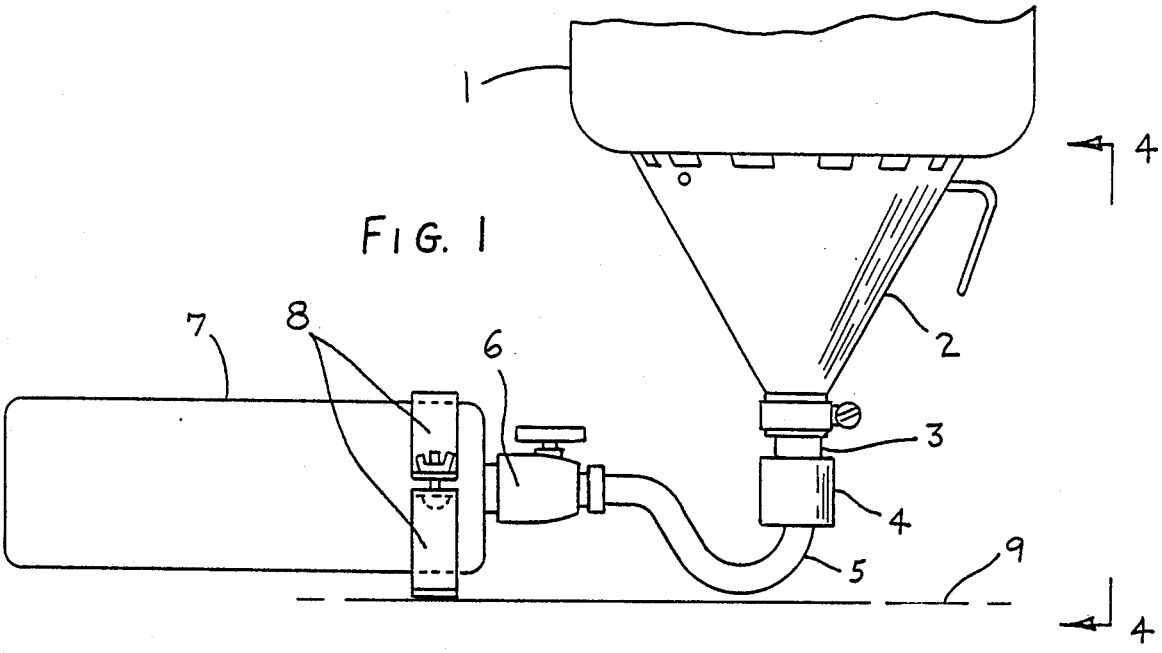
FIG. 1 shows the invention placed beneath an engine as it would be used.

FIG. 1 illustrates the invention's major parts in place beneath the oil pan 1 of an automotive type internal combustion engine. The bottom of the generally hollow conical upper shield 2 is clamped to the upper outside diameter of a standard torch nozzle or burner 3. Hollow cylindrical lower shield 4 at its upper end surrounds and has diametral clearance with the lower outside diameter of torch nozzle or burner 3. The lower end of lower shield 4 surrounds and is sealed to gas supply pipe 5. Torch gas valve 6 and propane tank 7 will normally be standard commercial torch components. Bolted two piece stand 8 clamps around the valve end of propane tank 7 and has two extremities which are bent to achieve correct positioning, support, and stability for the upper shield 2 directly beneath the oil pan 1 by their bearing upon the ground or floor 9. The opposite end of the cylinder may or may not also bear on the ground or floor 9 depending upon particular stand adjustment conditions.

Figure 2:
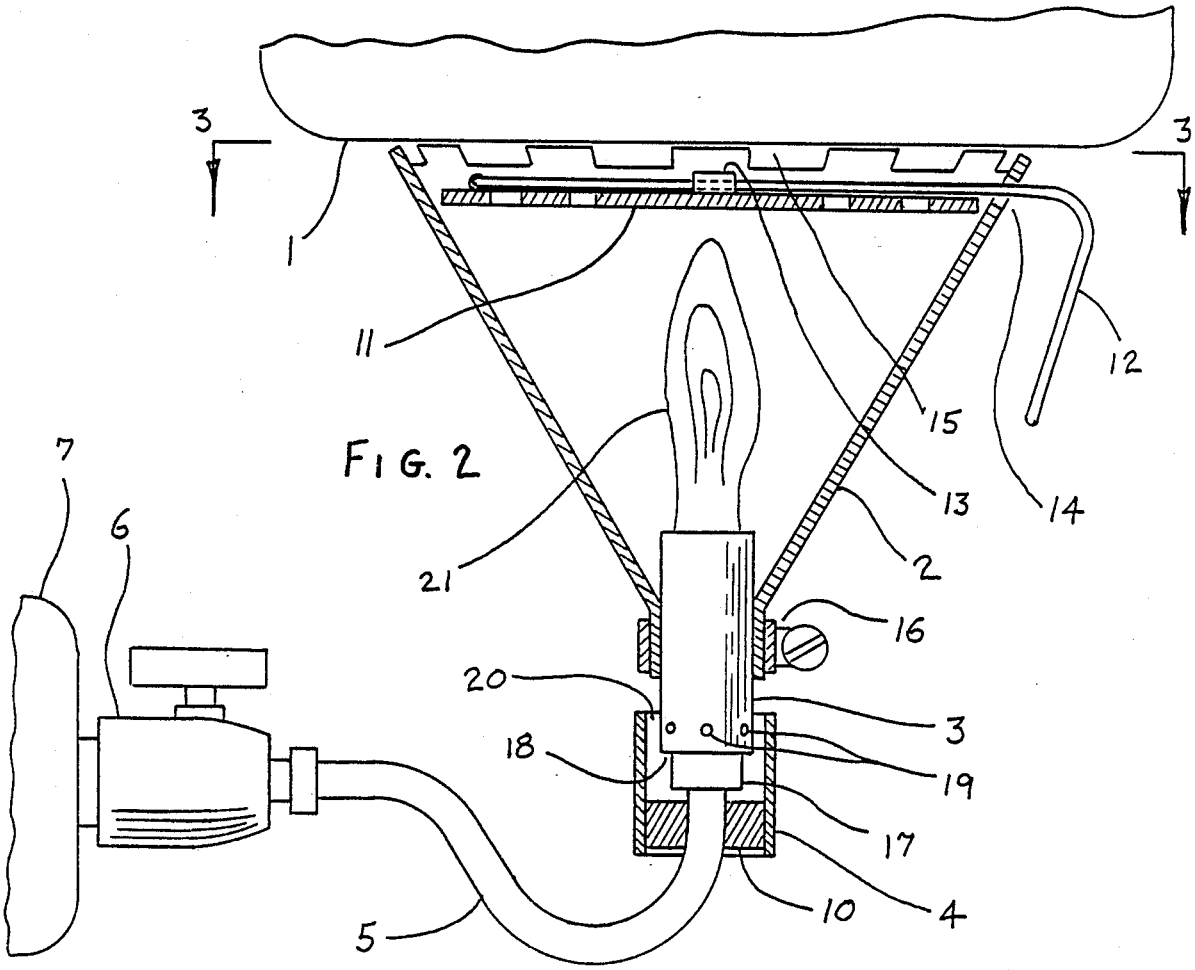
FIG. 2 is in one part a vertical section of the flame shields and impingement barrier assembly and is also in another part a partial view of the torch assembly.
Figure 3:
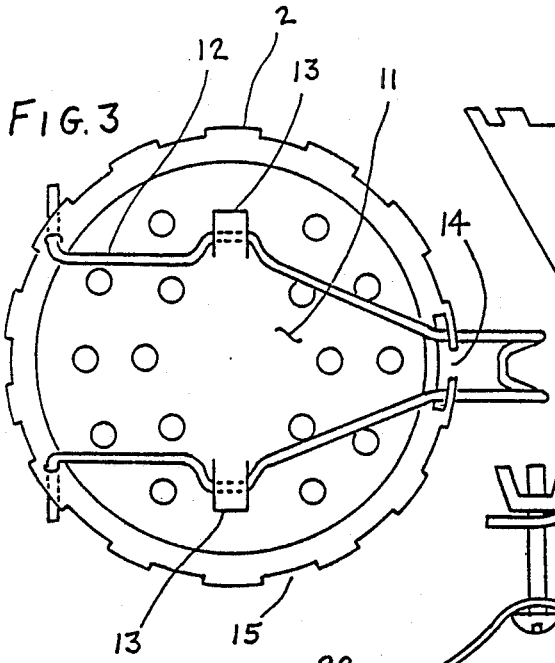
FIG. 3 is a partial top view taken upon the line 3—3 upon FIG. 2.

In FIG. 2 relationships are shown in more detail. Lower shield cylinder lower end seal 10 prevents upward air flow at this point and also holds lower shield 4 in place. Movable flame impingement barrier 11 resides near the top of upper shield 2 in a horizontal plane when in use and allows heated combustion products of the torch to pass upwards around its periphery and also through perforations mostly located away from its center. FIG. 3 shows how formed wire 12 is attached to impingement barrier 11 by bent attachment tabs 13 integral with impingement barrier 11. Formed wire 12 has two opposed and axially aligned stub ends each of which is bent at 90° from the adjacent portions of the wire. These stub ends of formed wire 12 serve as the hinge axles and attachment means for the impingement barrier 11 at their penetration of two holes in upper shield 2. The opposite end of formed wire 12 is formed in such a way that, in use, it acts as a spring lock when two opposing sides are engaged in a T - slotted portion 14 of the upper rim of shield 2 and the two sides are held apart by spring action. The lock action is released when the two opposing sides of the wire are manually deflected toward each other so that the deflected sides can pass through the opening of said T - slot 14 and allow swinging open the impingement barrier 11 for lighting the torch. When in use, the metal impingement barrier 11 is in the down or horizontal position and locked by the locking feature of formed wire 12.

At the upper rim of upper shield 2 are crenellations or notches 15 to allow escape of the torch's combustion products with the upper shield 2 pressed against the bottom of engine oil pan 1. Upper shield 2 may or may not have perforations of its generally conical wall.

The lower end of upper shield 2 is held to the upper end of standard torch burner or nozzle 3 with circumferential clamp 16. Some standard torch nozzles or burners have a lower portion generally configured as shown by item 17. With this type of burner the inlet air to the burner passes upwards through an annular passage depicted at point 18. Other burners or nozzles are configured differently and receive inlet air through alternative holes, generally disposed as indicated by items 19, before passing axially upwards into the air and gaseous fuel mixing chamber of the burner or nozzle 3.

The preceding discussion of the two general alternative air intake methods used in common commercial propane torches is only offered to clarify the intent of the drawing FIG. 2. The invention in part provides a lower shield 4 which isolates either type of inlet, 18 or 19, from direct wind action and also causes air to pass downwards through an annular opening 20. It can be seen that impingement barrier 11 prevents flame 21 from directly acting on the bottom of engine oil pan 1.

Figure 4:
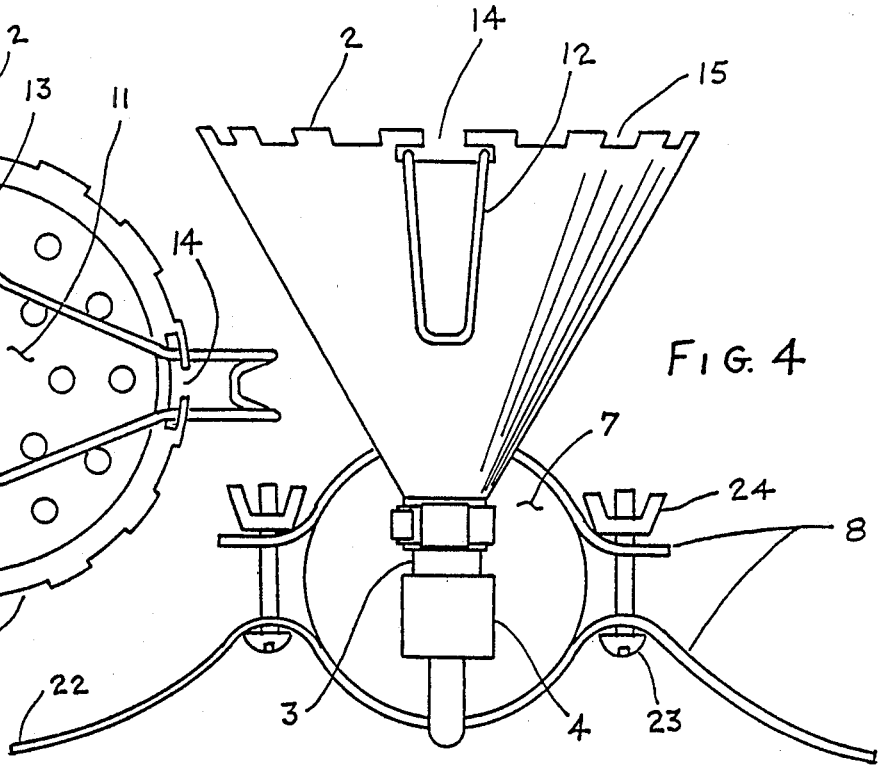
FIG. 4 is a side elevation taken upon the line 4—4 upon FIG. 1.

In FIG. 4 it can be seen how the ends 22 of the lower half of the bolted two piece stand 8, which is made of a ductile metal, can be bent to contact the ground or floor 9 and provide support to the torch and heater assembly as shown in an overall view in FIG. 1. Stove bolts 23 and wing nuts 24 clamp the two halves of the two piece stand 8 securely around the cylindrical propane tank 7 and hold the torch and heater assembly in proper position for heating the oil pan 1.

Figure 5:
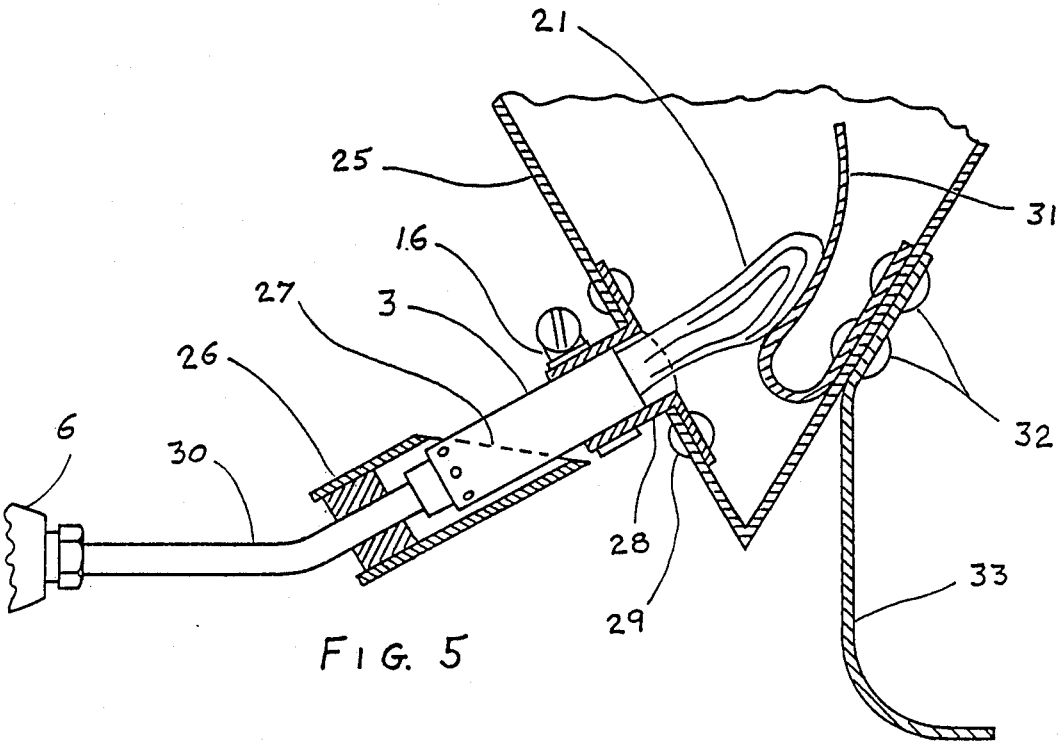
FIG. 5 is a partial vertical section of an alternate preferred embodiment.

FIG. 5 depicts an alternate preferred embodiment of the invention. The main difference in this alternative embodiment are; the alternate upper shield 25, the alternate lower hollow cylindrical shield 26 with its top end 27 cut at an angle less than 90° from its main axis so that in use this top end approaches a horizontal plane, a side entry fitting 28 held to an alternate upper shield 25 by fasteners 29, and a standard torch gas supply pipe 30. Formed sheet metal flame deflector 31 is fastened to the inside wall of the upper shield 25 with fasteners 32 which also attach a support piece 33 for additional stability for this configuration. The purpose of this alternate preferred embodiment, as shown in FIG. 5, is to allow the use of a standard commercial torch completely as-is by utilizing the standard gas supply pipe 30 which normally will have approximately a 30 degree bend. It can be seen that the gas supply pipe 5, as shown in FIGS. 1 and 2, is bent to have its discharge end pointing vertically upwards.

My invention has been tested and found to be completely satisfactory for the accomplishment of the above objectives and while I have shown two preferred embodiments thereof, I wish it to be understood that same may be capable of modification without departure from the scope and spirit of the claims.

Having described the purpose and operation of the invention what is claimed is:

1. A small portable heater device for heating a conventional automotive type internal combustion engine by utilizing a compressed combustible gas fired torch having attached to and surrounding its burner's discharge end a hollow metal housing which serves as both a flame wind protector and as an exhaust plenum by receiving the burner's flame and other hot exhaust products into its interior cavity and causing discharge of said hot exhaust products from ports around the top of said housing thus causing the hot exhaust products to contact and directly flow over a portion of the bottom of an oil pan of said engine where top of said housing is held in at least partial contact.

2. The small portable engine heater of claim 1 wherein the flame wind protection function is accomplished in two ways; firstly by said dual purpose housing blocking wind from directly acting on the flame and; secondly by said housing acting in concert with the torch burner outer intake air port such that said discharge porting of said housing and said outer intake air port of the torch burner are subject to essentially the same wind velocity and stagnation pressure conditions due to the construction being comprised of the following primary features provided for this purpose:

(a) an upward facing horizontally disposed annular outer intake air port for the burner formed by a hollow cylindrical air ducting piece which at its upper end surrounds and has diametral clearance with approximately the lower half of said torch burner's lower, intake, end and which at its lower end surrounds and is sealed to said burner's gas supply pipe outside diameter thus causing the burner outer intake air flow to be downwards through the annular passage formed between the burner lower end and the air ducting piece upper end;

(b) an essentially air tight connection of the inside diameter of the lower end of said dual purpose housing to the outside of the upper, discharge, end of the said burner.

3. The small portable engine heater of claim 1 wherein said metal housing contains inside and near its top a generally flat, horizontally disposed, plate piece which acts as a flame barrier by virtue of its unperforated center section being directly in line with and generally perpendicular to the burner's flame cone centerline while at the same time allowing the hot burner exhaust products, but not flame, to pass upwards through perforations generally dispersed around the periphery of said flame barrier plate piece.

4. The small portable engine heater of claim 1 wherein the whole heater assembly is stably supported by, and thusly the top of the exhaust plenum of said heater is held to the bottom of said engine's oil pan by, a metal supporting bracket which in its simplest configuration firstly clamps around the circumference of said heater's integral fuel tank and secondly has two, or more, adjustable foot pieces for bearing on either ground or floor to obtain proper positioning and foundationing of said heater assembly.

5. Means of heating a conventional automotive type internal combustion engine by heating its oil pan and oil utilizing a small portable heating device comprising:

(a) a compressed combustible gas fired torch;

(b) an exhaust plenum housing attached to and surrounding said torch's burner discharge end and extending upwards terminating in an open top with a horizontally disposed upper rim containing either multiple perforations just below and around the periphery of said rim or crenellations as part of said rim periphery;

(c) a horizontally disposed plate piece having multiple perforations only in its peripheral surface area, said plate piece being hingedly attached to said housing and residing within and just below the upper rim of said housing thereby making said plate piece a partial top closure piece for said housing;

(d) a hollow cylindrical air intake ducting piece which at its upper end surrounds and has diametral clearance with said torch burner's lower, intake, end and which at its lower end surrounds and is sealed to said burner's gas supply pipe thus causing the burner intake air flow to be downwards through said ducting piece's upper diametral clearance area with said torch burner lower end;

(e) a support bracket which can be adjusted to provide stable support and proper positioning of the heater assembly and, most particularly, the holding of the upper, discharge, end of said exhaust plenum housing in at least partial contact with the bottom of said engine's oil pan.

* * * * *